US005316139A

United States Patent [19]

Judd et al.

[11] Patent Number: 5,316,139

[45] Date of Patent: May 31, 1994

[54] SHIRT STORAGE AND PACKAGE APPARATUS

[75] Inventors: Thomas W. Judd, Peterborough, N.H.; Cyril Wagner, Jr., Midland, Tex.

[73] Assignee: Curtis Manufacturing Company, Inc., Jaffrey, N.H.

[21] Appl. No.: 63,207

[22] Filed: May 18, 1993

[51] Int. Cl.[5] ..... B65D 85/18

[52] U.S. Cl. ..... 206/278; 206/292; 206/296; 206/470; 206/493

[58] Field of Search ..... 206/278, 292, 293, 295, 206/296, 461, 467, 470, 493, 387, 472, 473, 474; 220/4.22, 4.23

[56] References Cited

U.S. PATENT DOCUMENTS

| | | | |
|---|---|---|---|
| 2,764,280 | 9/1956 | Carper | 206/278 |
| 2,973,857 | 3/1961 | Richer | 206/292 |
| 3,767,110 | 10/1973 | Congleton | 220/4.23 |
| 3,891,070 | 6/1975 | Montanari | 220/4.23 X |
| 4,289,235 | 9/1981 | Egly | 206/387 |
| 4,795,029 | 1/1989 | Campbell et al. . | |
| 4,962,854 | 10/1990 | Ricci | 206/387 |
| 5,012,971 | 5/1991 | Cozzi et al. | 220/4.23 X |
| 5,044,497 | 9/1991 | Weisburn et al. | 206/387 |
| 5,152,710 | 10/1992 | Montgomery | 220/4.23 X |

*Primary Examiner*—Jacob K. Ackun, Jr.
*Attorney, Agent, or Firm*—Richard P. Crowley

[57] ABSTRACT

A shirt storage and package apparatus for the shipping, storage, and display of shirts is described. The apparatus, preferably made of integrally molded polyvinylchloride plastic to insure visibility, includes a top cover having a generally rectangular shape; an upright collar insert integrally molded within and perpendicular to the plane of the cover; a bottom cover substantially identical to and placed opposite in orientation to the top cover; a means for moving the top and bottom covers between an open and a closed position; and a means for releasably locking the top and bottom covers to one another. The upright collar insert is adapted to fit within a shirt collar, thereby maintaining the the shirt in a non-crushable position. Two shirts can be accommodated in a back-to-back position and opposite orientation from one another within each apparatus, thereby allowing easy user and consumer inspection.

11 Claims, 1 Drawing Sheet

SHIRT STORAGE AND PACKAGE APPARATUS

BACKGROUND OF THE INVENTION

Plastic packages are made in a diversity of shapes and sizes for the display and storage of merchandise. Some plastic packages are designed for visual inspection so that customers can make informed purchasing decisions without having to open a package, while others are opaque and provide protection during the shipping and transportation of an item.

Semi-rigid plastic bubble packages, in which a plastic bubble is molded to conform to a certain shape and size and is affixed to a plastic or paper backing, find extensive use in rack merchandising of items. Reclosable plastic packaging provides added advantages of possible "hands on" inspection of an item and storage of remaining, unused portions of items.

Plastic packaging for articles of clothing has been directed toward small accessory items like jewelry, belts, ties, and hair ribbons, and crushable items such as hosiery and slippers. Such packaging is generally of a semi-rigid bubble type or small, rigid, half-opaque hinged box type, that provides limited visual inspection of an item. Neither of these types of packaging is adaptable for larger items of clothing that would provide protection from crumpling and wrinkling and yet allow nearly complete visual inspection for consumer information.

Therefore, it would be advantageous to provide a plastic package that would be adaptable for larger articles of clothing. It further would be desirable to provide a rigid plastic container to prevent articles contained therein from being crushed and wrinkled. Semi-rigid plastic bubbles with paper or plastic backings and cardboard boxes do not provide sufficient rigidity to overcome this difficulty.

U.S. Pat. No. 4,795,029, issued Jan. 3, 1989 to Campbell et al, shows a shoe display and storage device. The device is a transparent plastic container whose bottom portion is molded in a preformed shape to receive a pair of shoes. The shoes are placed adjacent each other with a toe of one shoe lying near a heel of its partner shoe. The preformed shape of the molded container bottom serves to lock the pair of shoes into position for shipment and display purposes. A variety of mold forms are employed to create shoe devices that will accommodate different sizes and styles of men's, women's and children's shoes.

It would be desirable to provide a plastic package that would allow complete visual inspection of one or more shirts for the information of a customer. Additionally, it would be desirable to have such a package maintain a shirt collar in a non-movable position during shipping, display and of storage of the shirt.

SUMMARY OF THE INVENTION

The invention relates to containers for shipping, storing and displaying articles of clothing and accessories in a back-to-back, compartmentalized relationship. In particular, it relates to a storage and package apparatus for shirts.

The shirt storage and package apparatus comprises a top cover of generally rectangular shape to receive a shirt; an upright collar insert to fit within a shirt collar and attached to the inside of the top cover; a bottom cover, substantially identical to the top cover but opposite the top cover in orientation, so that placement of the top cover on the bottom cover results in the formation of a space between the covers; a means for moving the top and bottom covers between an open position and a closed position relative to one another; and a means for releasably locking the top and bottom covers to one another such that two shirts can be held within the container in a back-to-back and reverse position during shipping, storage and display.

The top and bottom covers may be made from any rigid, and particularly a molded, transparent material of choice that will provide protection for the shirts within the apparatus as well as preferably provide visibility of the shirts for user and consumer inspection. In a preferred embodiment, the top and bottom covers are molded from polyvinylchloride (PVC) plastic which may be clear, tinted or a combination of both. In addition, the top cover may optionally have a lip portion coextensive with its edges and directed outwardly away from the inside of the cover. The bottom cover is constructed in a substantially identical manner to the top cover so that when the top and bottom covers meet in opposite orientation, their lip portions rest on one another. In a preferred embodiment, the lip portion of a cover is composed of a plastic material, more particularly of PVC plastic, integrally molded with the edge of the cover.

The upright collar insert is located on a flat, inner portion of each cover and is generally perpendicular to the plane of the cover. It is nearer one of the two shorter sides of the generally rectangular shape of the cover, and thereby corresponds to a position of a shirt collar when a shirt is placed within the apparatus. The shape of the upright collar insert is adapted to fit inside a shirt collar and is of a height sufficient to maintain the shirt collar in a non-crushable position during shipping, storage and display. Upright collar inserts may vary in height from those sufficient to maintain in place a shirt collar on a man's dress shirt to a height sufficient to maintain in place the ribbed collar of a child's polo shirt.

In a preferred embodiment, the upright collar inserts are hollow and integrally molded within the inner, flat portions of the top and bottom covers. In another embodiment, the upright collar inserts are detachably affixed to the flat, inner portions of the top and bottom covers. In yet another embodiment, the upright collar inserts are preformed, adjustable bands of suitable size and shape to fit within shirt collars. Such construction provides a place for cuff links, tie tacks and other small accessories within the central, open space of the upright collar inserts.

Upright collar inserts are constructed in any number of circumferences in order to fit within a variety of shirt collar sizes, and may range in size from about 6–18 inches. In addition, they may be fabricated from any suitable material that will provide rigidity and non-crushable support for a shirt collar including, but not limited to, metal compositions, cardboard of varying weights, styrofoam cushions and stiffened fabrics. Again, the preferred embodiment includes a hollow, upright collar insert made of PVC plastic and integrally molded within the top and bottom covers. The upright collar inserts may also be fabricated as a solid piece, integrally molded within or attached to each of the covers.

The means for moving the top cover relative to the bottom cover between a shirt-receiving and shirt-removing position and a closed shirt-protecting position, may be any means of choice that will accomplish such movement such as, for example, snaps and tabs. In addition, one or more hinges located on an adjoining side of the top and bottom covers will provide angular movement for opening and closing the apparatus. In a preferred embodiment, the adjoining lengths of one edge of the top cover and a corresponding edge of the bottom cover are affixed to one another by means of a flexibly molded plastic piece, preferably of PVC plastic, thereby forming a "living hinge."

The means for releasably locking the top and bottom covers to one another when so desired may include a means of choice such as, for example, magnets, snaps, belts, straps, interlocking tabs preformed within the top and bottom covers, fabric fasteners, and complementary ridge and crevice formations within the lip portions of the top and bottom covers disposably arranged for interaction. In a preferred embodiment, two sets of interlocking plastic snaps are integrally molded with the top and bottom covers and are formed along one adjoining side of the top and bottom cover lip portions of the apparatus to effect its releasable locking.

An optional thin, detachable sheet may be employed to separate a first shirt from a second shirt contained within the shirt storage and package apparatus. In a preferred embodiment, the detachable sheet is composed of a thin, transparent plastic film piece, preferably made from PVC plastic, and having a means for attachment at the lip portions of the top and bottom covers. The detachable piece provides additional support for maintaining shirts in a defined, non-crushable position during display, storage, and shipping.

One or more optional, integrally molded plastic handles may be attached to the exterior of the apparatus for user convenience in carrying shirts within the apparatus and for display purposes when hanging shirts on merchandise display racks.

The shirt storage and package apparatus may be constructed in a number of sizes to accommodate shirts for men, women and children. Measurements of the apparatus range from about 8–15 inches in width, 10–18 inches in length, and 2–6 inches in depth, depending on the size of the shirts to be packaged. One embodiment of the invention is especially adapted to maintain the positions of two flat, knit shirts such as, for example, polo shirts and turtleneck shirts, in a position for shipping, storage and display, and has a depth of about 2 inches and an upright collar insert of about ⅛–174 inch.

Another embodiment of the invention includes the joining of top and bottom covers having different upright collar insert heights and circumferences to accommodate different sizes and styles of shirts within a single shirt storage and package apparatus. Yet another embodiment of the invention includes multiples of two upright collar inserts located on opposite ends of the top and bottom covers to accommodate, for example, four or either infant shirts in one apparatus.

The invention will be described for the purposes of illustration only in connection with certain embodiments; however, it is recognized that those skilled in the art may make various modifications, changes, additions and improvements to the certain embodiments, all falling within the spirit and scope of the invention.

DESCRIPTION OF THE EMBODIMENTS

Figure 1:
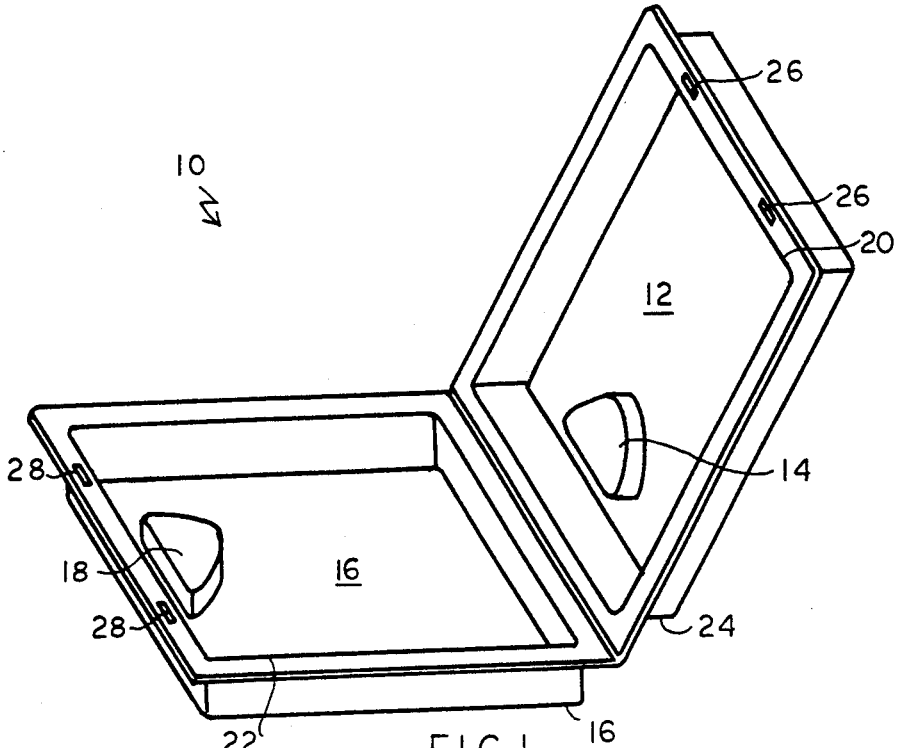
FIG. 1 is a perspective view of a shirt storage and package device for holding two shirts showing the identical but oppositely oriented members in an open position.

FIG. 1 shows a shirt storage and package device 10 in general.

Figure 5:
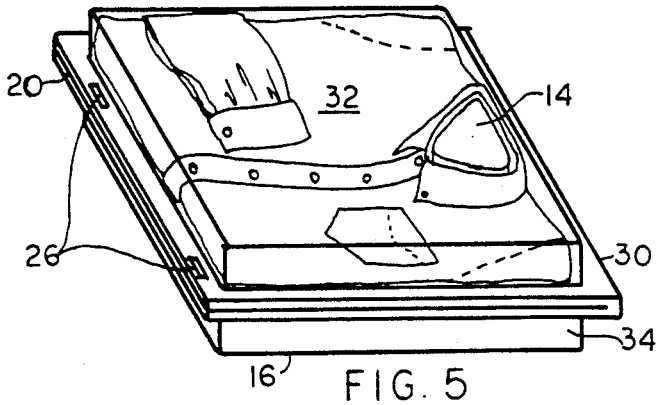
FIG. 5 is a perspective view of a shirt placed within the apparatus.

A top cover 12 has a generally rectangular shape and size sufficient to hold a folded shirt 32, (See FIG. 5).

An upright collar insert 14 is located on and is generally perpendicular to the top cover 12. The upright collar insert 14 is positioned near a first end of the shirt storage and package apparatus, and on the generally rectangularly shaped top cover 12 to receive a shirt collar when a shirt 32 is placed within the apparatus 10. The upright collar insert 14 is of sufficient height to maintain a shirt collar in a non-crushable position during storage, shipping and display.

A bottom cover 16 is fabricated substantially identically to the top cover 12. An upright collar insert 18 is placed near a second end of the shirt storage and package apparatus, and on of the generally rectangular shaped bottom cover 16. The upright collar insert 18 lies generally perpendicularly to the plane of the bottom cover 16. It too is adapted to receive a collar of a shirt 34 and is of sufficient height to maintain the shirt collar in a non-crushable position when the shirt 34 is contained within the apparatus 10. (See FIG. 5.)

FIG. 1 shows a lip portion 20 co-extensive with the top cover 12 and directed outwardly away from the inside of the top cover 12 and directed outwardly away from the insert 14 is located. Similarly, a lip portion 22 is co-extensive with the bottom cover 16 and also is directed outwardly away from the inside of the bottom cover 16 where the upright collar insert 18 is located.

Figure 2:
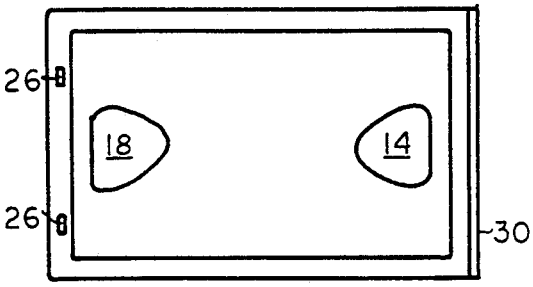
FIG. 2 is a plan view of the device of FIG. 1 in a closed position.
Figure 3:
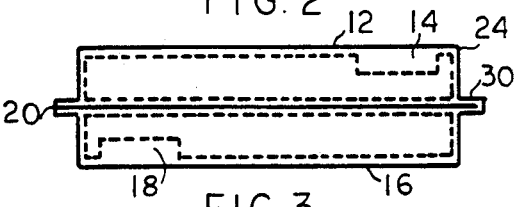
FIG. 3 is a transparent side view of the device of FIG. 1 showing a film sheet interposed between the two members of the device in a closed position.
Figure 4:
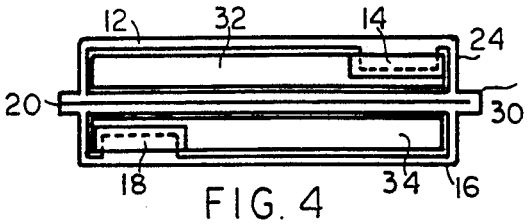
FIG. 4 is an shaded side view of the device of FIG. 1 showing placement areas for two shirts oppositely disposed therein.

A hinge 24 extends along an adjoining edge of the lips 20 and 22, thereby providing movement between the top cover 12 and bottom cover 16 relative to one another. The hinge 24 allows movement of the covers between an open, shirt-receiving or shirt-removing position (FIG. 1) and a closed, shirt-storage, shirt-shipping and shirt-display position (FIGS. 2–4). It is recognized that any number of other devices may be utilized to perform this same function.

FIG. 1 also shows a pair of plastic snaps 26 and 28 disposed along one edge of the lip 20 of the top cover 12 and the adjoining edge of the lip 22 of the bottom cover 16. The plastic snaps 26 and 28 releasably lock the top cover 12 to the bottom cover 16 whenever desired. A variety of alternative closing articles may be used in place of the plastic snaps without altering the invention.

FIGS. 3 and 4 show the placement of the optional thin, transparent sheet 30 that separates one shirt 32 from another shirt 34 as the shirts are placed within the apparatus 10.

As seen in FIGS. 2, 3 and 4, the top cover 12 and bottom cover 16 are arranged relative to one another so that each has an orientation opposite that of the other. The positions of the upright collar inserts 14 and 18, each adapted to receive and hold a shirt collar in place, assure that the fronts of the two shirts contained within the apparatus 10 will be visible through the outsides of the top cover 12 and bottom cover 16. The two shirts 32 and 34 are carried, stored and displayed in a back-to-back and reverse position relative to one another, and are separated by the thin sheet of transparent plastic 30 which provides even further support to maintain the uncrushed positions of the shirts.

FIG. 5 shows a shirt 32 within the shirt storage and package apparatus 10 with the upright collar insert 14 placed within a shirt collar so as to protect the shirt collar in a non-crushable position. The transparency of the apparatus provides easy user and consumer inspection of the shirt contained therein.

What is claimed is:

1. In combination:

a) a shirt storage and package apparatus to receive and store two folded shirts, each shirt having a shirt collar, which apparatus comprises:

i) a top cover having a generally rectangular shape, said top cover comprising a rectangular and generally planar inner wall portion having a periphery, upright sidewalls joined to each other at ends thereof and further joined to said periphery, said sidewalls extending orthogonally to said inner wall portion to define with said inner wall portion an interior of said top cover, said sidewalls having edges at sides thereof opposite to said inner wall portion;

ii) a bottom cover substantially identical to and placed in an orientation opposite from the top cover, so as to form a shirt-receiving space between the covers to receive two folded shirts when in a closed position;

iii) a means for moving the top and bottom covers between an open and closed position relative to one another;

iv) a means for releasably locking the top and bottom covers to one another;

v) a pair of collar inserts, one of said pair of collar inserts extending orthogonally from the inner wall portion of the top cover into the interior of said top cover at one end thereof, the other of said pair of collar inserts extending orthogonally from the inner wall portion of the bottom cover into the interior of said bottom cover at an end thereof opposite to said one end, said pair of collar inserts; of a size, shape, and height to permit insertion of each collar insert within the shirt collars of two folded shirts that lie in a back-to-back and opposite direction relative to one another within the shirt-receiving space to maintain the shirt collars in a noncrushable position; and b) a pair of folded shirts in a back-to-back, reverse, stored position within said apparatus with said collar inserts inserted within the collars of said shirts" has been inserted immediately.

2. The combination of claim 1 wherein the top and bottom covers comprise a transparent plastic material.

3. The combination of claim 2 wherein the transparent plastic material is polyvinylchloride (PVC).

4. The combination of claim 2 wherein the the top cover, bottom cover, and collar inserts are integrally molded from the same material.

5. The combination of claim 1 wherein each collar insert comprises a generally triangularly-shaped element in a top plan view of the covers.

6. The combination of claim 1 which includes an outwardly extending lip portion coextensive with the edges of the top and bottom covers.

7. The combination of claim 1 wherein the means for moving the top and bottom covers comprises a hinge means secured between the edges of the top and bottom covers.

8. The combination of claim 6 wherein the means for releasably locking the top cover to the bottom cover comprises at least one pair of interlocking snaps located on adjoining lip portions of said covers.

9. The combination of claim 1 which includes a thin, detachable sheet positioned between the top and bottom covers of a closed shirt storage and package apparatus to separate two folded shirts contained therein.

10. The combination of claim 9 wherein the thin, detachable sheet comprises a transparent plastic material.

11. The combination of claim 1 which includes a thin, detachable sheet of transparent material located between the folded shirts and to separate the folded shirts contained within said apparatus.

* * * * *

UNITED STATES PATENT AND TRADEMARK OFFICE

CERTIFICATE OF CORRECTION

PATENT NO. : 5,316,139

DATED : May 31, 1994

INVENTOR(S) : Thomas W. Judd/Cyril Wagner, Jr.

It is certified that error appears in the above-identified patent and that said Letters Patent is hereby corrected as shown below:

Title page, item (21)

Delete "63,207" and insert --63,217--

Column 6, line 13, after shirts delete " "has been inserted immediately"

Signed and Sealed this

Fourth Day of October, 1994

*Attest:*

*Attesting Officer*

Bruce Lehman

BRUCE LEHMAN

*Commissioner of Patents and Trademarks*